US005582122A

United States Patent [19]

Funderburk et al.

[11] Patent Number: 5,582,122

[45] Date of Patent: Dec. 10, 1996

[54] FEED SYSTEM FOR A SEWING MACHINE

[75] Inventors: C. Michael Funderburk, East Bend; P. Kurt Jordan, Kernersville, both of N.C.; John A. Newman, Austinville, Va.; J. C. McEwen, Mocksville; David C. Howell, Clemmons, both of N.C.

[73] Assignee: Sara Lee Corporation, Winston-Salem, N.C.

[21] Appl. No.: 444,711

[22] Filed: May 19, 1995

Related U.S. Application Data

[62] Division of Ser. No. 42,547, Apr. 5, 1993, Pat. No. 5,461, 998.

[51] Int. Cl.[6] ..... D05B 21/00

[52] U.S. Cl. ..... 112/470.07; 112/470.28; 112/306

[58] Field of Search ..... 112/475.03, 475.02, 112/475.04, 470.28, 470.07, 470.06, 470.03, 470.02, 153, 306, 311, 304, 305

[56] References Cited

U.S. PATENT DOCUMENTS 4,066,027 1/1978 Marforio ..... 112/470.28
4,086,860 5/1978 Kosrow et al. ..... 112/306 X
4,315,470 2/1982 Torre et al. ..... 112/470.28
4,928,609 5/1990 Kawasaki ..... 112/470.28 X

*Primary Examiner*—Peter Nerbun
*Attorney, Agent, or Firm*—Rhodes Coats & Bennett, L.L.P.

[57] ABSTRACT

An apparatus for automatically feeding one edge of a textile article to a sewing machine. The apparatus includes a first gripper adjacent to the sewing machine for gripping the leading portion of the edge of the textile article. A feed dog is adjacent to the first gripper for advancing the edge of the textile article with respect to the sewing machine. A second gripper grips the trailing portion of the edge of the textile article. A positioner supporting the second gripper means moves the second gripper with respect to the feed means. Finally, a programmable controller controls the movement of the positioner to advance the trailing portion of the edge of the textile article in response to the movement of the leading portion of the edge of the textile article.

154 Claims, 5 Drawing Sheets

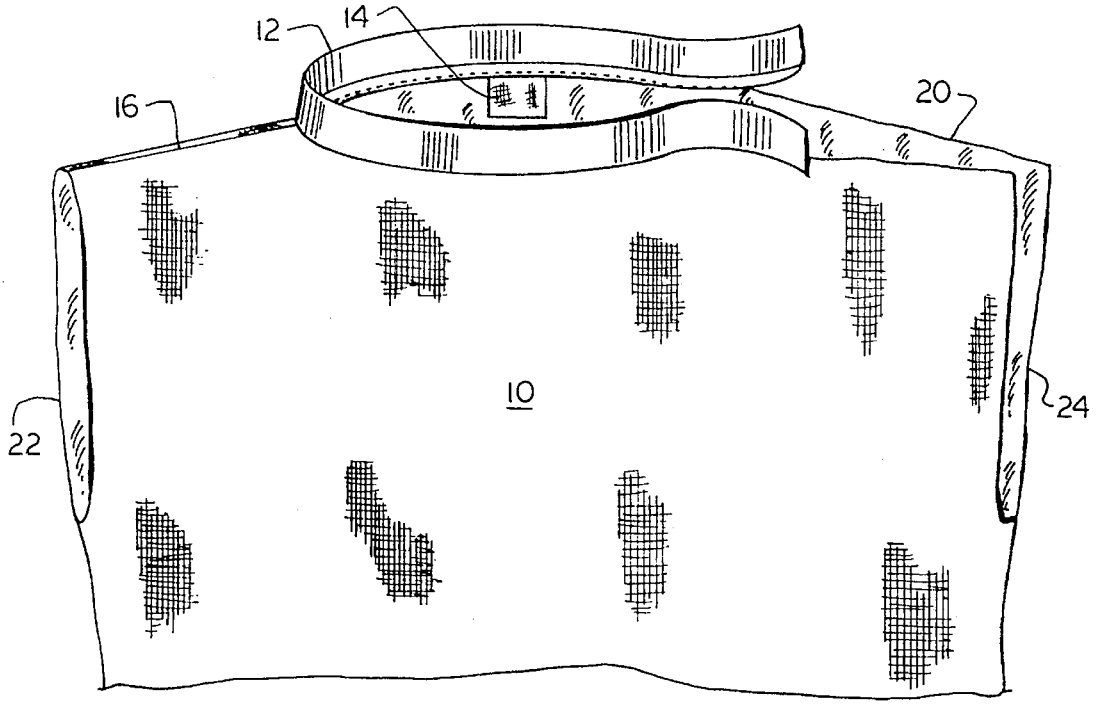
FIG. 1
FIG. 2
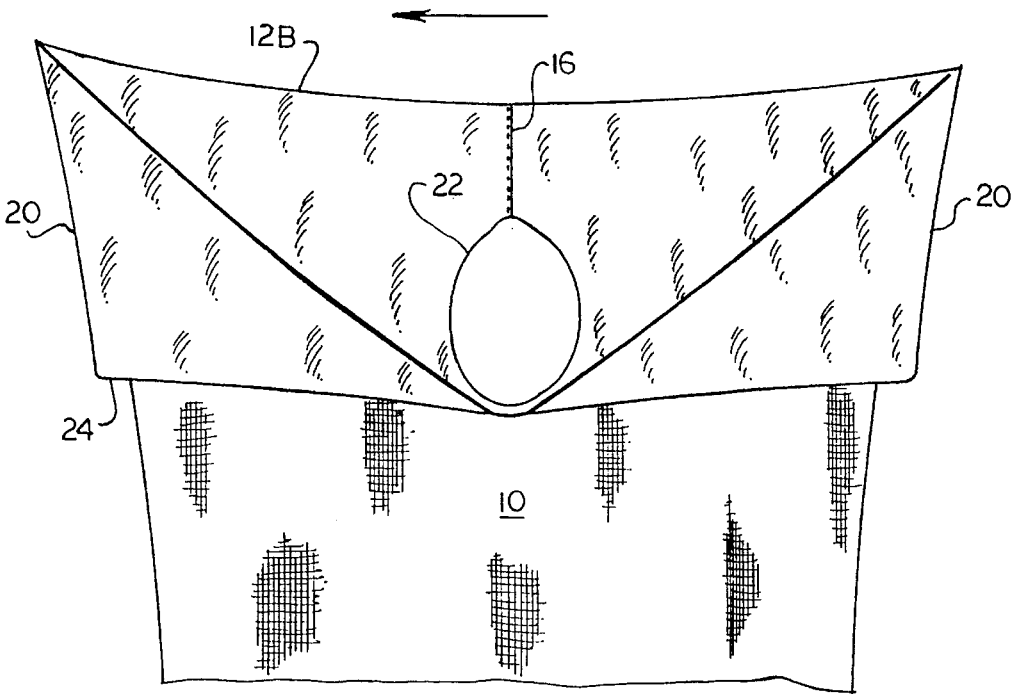

FEED SYSTEM FOR A SEWING MACHINE

CROSS REFERENCE TO RELATED APPLICATIONS

This application is a division, of application Ser. No. 08/042,547, filed Apr. 5, 1993 now U.S. Pat. No. 5,461,998.

This application is related to Applicants' applications Ser. Nos. 07/711,315, now U.S. Pat. No. 5,375,545 and 07/711,659, now U.S. Pat. No. 5,315,946, both filed Jun. 6, 1991, the disclosures of which are hereby incorporated by reference in their entirety.

BACKGROUND OF THE INVENTION (1) Field of the Invention

The present invention relates generally to sewing machines and, more particularly, to an apparatus for precisely feeding a collarette to a sewing apparatus for automatically attaching the collarette to a garment body.

(2) Description of the Prior Art

Garments such as shirts or blouses are typically manufactured using manual labor. Garment pieces are cut out of stock material, trimmed to proper dimensions, and then sewn together on a sewing machine by a sewing machine operator. Often in garment manufacturing, a piece of material, known in the art as a "collarette", is folded and sewn around the garment neck to form a continuous collar. The conventional method of sewing a collarette to a garment neck is performed by a sewing machine operator in the following manner.

First, the collarette is cut to a size slightly shorter than the garment neck edge where the collarette is to be sewn. Then, the operator positions the collarette on top of the garment body, places the material under a sewing machine and starts sewing. While sewing, the operator must continually maintain the alignment of the collarette and garment body to obtain an evenly manufactured finished product. Additionally, the operator must pull and stretch the collarette during the sewing operation. Stretching the collarette in such a manner will cause the completed garment and collarette to lie flat and have no wrinkles or gathers around the neck when worn.

The operator may also be required to attach a label (e.g. a manufacturer's identifier having the manufacturer's name and product information) to the garment with the same stitch being used to attach the collarette to the garment. To perform this operation, the operator must carefully position and hold the label in the desired location while sewing. Additionally, the operator may be required to sew a small strip of material, known in the art as a "display", to the inside of the garment neck to flatten and cover the seam joining the collarette and label to the garment body (the "joining seam"). The display is used to cover the area inside the garment where the joining seam would be partially visible after the garment is packaged for sale, i.e., on the inside back portion of the garment neck. To sew a display, the operator must carefully position the display on top of the collarette and garment body and hold the display in position while sewing.

Further complications to the above-described conventional sewing operation are encountered when the joining seam (known as an "overedge seam") is to be hidden from view from the outside of the garment (i.e. the side of the garment away from the body of the wearer). To hide the overedge seam, an operator must layer the collarette, display, and label on top of the garment body, and use an "overedge stitch" to join the pieces together. The resulting overedge seam is then hidden from the outside of the finished garment.

To sew a collarette, label, and display to a garment body with an overedge stitch, an operator must first manually arrange and layer the materials one on top of the other as follows: garment body, collarette, display, and label. The operator then passes the layered materials through the sewing machine, maintaining them in constant alignment while stretching the collarette as described above. If desired, a second sewing operation is then performed to attach the loose edge of the display to garment body with a cover stitch to assure that the display covers the overedge seam and a portion of the label.

The manual process of sewing a collarette, display, and label to a garment body is difficult and tedious. The quality of the finished product is often variable and is largely dependent on the experience and skill of the sewing machine operator. Moreover, the conventional process is time consuming due to the need to precisely arrange and sew the materials together.

A partial solution to the above-identified problems is disclosed in co-pending patent application U.S. Ser. No. 07/711,659. U.S. Ser. No. 07/711,659 discloses a method and apparatus for automatically attaching a collarette, display, and label to a garment body using, inter alia, a collarette feed means, display feed means, label feed means and a controller means. As disclosed therein, the controller means counts the total number of stitches since the start of a sewing operation. When the total stitch count equals certain predetermined stitch counts, the controller means commands the display feed means and label feed means to feed their respective material under a sewing head. Variations in garment body dimensions often occur within a particular garment body size. For example, a garment neck edge can vary in length from garment to garment within a garment size by as much as plus or minus one inch (+/−1") resulting in an overall length variation of four inches (4"). The use of predetermined total stitch count values based on the start of the sewing operation to command display and label feeding can not account for the above described variations that exist within a garment size. As a result, inconsistent placement of display and label can occur.

Additionally, using a motor to drive the label feed means independently from, i.e. unsynchronized with, the motor driving the sewing head can cause the label to be misaligned when placed under the sewing head and cause the label to skew. Further, feeding the collarette and display material on top of the garment body can obstruct the field of view of the sewing head, making it difficult for an operator to assure the sewing operation is being performed properly. Finally, the layering of garment body, collarette, display, and label can complicate the automation of a subsequent operation necessary to sew the loose edge of the display over the overedge seam with a cover stitch. Specifically, automating the second sewing operation when the display and collarette is placed on top of the garment body would require an apparatus to be able to fold the display underneath the garment body and then to sew "blind" through the garment body and collarette. Such an apparatus would be difficult to construct and operate and would prevent the operator from being able to visually check whether the display has been folded and sewn properly in the second sewing operation until after the operation is complete.

Another partial solution to the above-identified problems is disclosed in U.S. Ser. No. 07/711,315. U.S. Ser. No.

07/711,315 discloses a collarette feed means, display feed means, label feed means, a seam detector means, and a controller means. As disclosed, the placement of the collarette, display, and label is determined by detecting the presence of the garment body shoulder seam. As a result, the collarette, display, and label are accurately placed on a garment body. Additionally, feeding of the collarette and display is performed underneath the garment body allowing for a clear view of the sewing head and for simplifying the joining seam.

Both co-pending applications require manual feeding of the garment body through the sewing head. Manual feeding of the garment body would often yield an inconsistent finished product and require constant attending by the machine operator. Thus, there remains a need for an apparatus for automatically feeding one edge of a textile article to a sewing machine.

SUMMARY OF THE INVENTION

The present invention is directed to an apparatus for automatically feeding one edge of a textile article to a sewing machine. The apparatus includes a first gripper adjacent to the sewing machine for gripping the leading portion of the edge of the textile article. A feed dog is adjacent to the first gripper for advancing the edge of the textile article with respect to the sewing machine. A second gripper grips the trailing portion of the edge of the textile article. A positioner supporting the second gripper means moves the second gripper with respect to the feed means. Finally, a programmable controller controls the movement of the positioner to advance the trailing portion of the edge of the textile article in response to the movement of the leading portion of the edge of the textile article.

In the preferred embodiment, a frictionless support is located between the first gripper and the second gripper for supporting the body of the textile article as the edge of the textile article is moved toward the sewing machine. The support includes a flexible cable having one end attached adjacent to the feed dog for supporting the body of the textile article; and a retractor connected to the other end of the cable and mounted adjacent to the gripper, whereby the cable is retracted into the retractor as the edge of the textile article is moved.

Accordingly, one aspect of the present invention is to provide an apparatus for automatically feeding one edge of a textile article toga sewing machine. The apparatus includes: (a) first gripper means adjacent to the sewing machine for gripping the leading portion of the edge of the textile article; (b) feed means adjacent to the first gripper means for advancing the edge of the textile article with respect to the sewing machine; (c) second gripper means for gripping the trailing portion of the edge of the textile article; (d) positioner means supporting the second gripper means for moving the second gripper with respect to the feed means; and (e) control means for controlling the movement of the positioner to advance the trailing portion of the edge of the textile article in response to the movement of the leading portion of the edge of the textile article.

Another aspect of the present invention is to provide an apparatus for automatically feeding one edge of a textile article to a sewing machine. The apparatus includes: (a) first gripper means adjacent to the sewing machine for gripping the leading portion of the edge of the textile article; (b) feed means adjacent to the first gripper means for advancing the edge of the textile article with respect to the sewing machine; (c) second gripper means for gripping the trailing portion of the edge of the textile article; (d) positioner means supporting the second gripper means for moving the second gripper with respect to the feed means; (e) control means for controlling the movement of the positioner to advance the trailing portion of the edge of the textile article in response to the movement of the leading portion of the edge of the textile article; and (f) support means located between the first gripper means and the second gripper means for supporting the body of the textile article as the edge of the textile article is moved toward the sewing machine.

Another aspect of the present invention is to provide an apparatus for frictionlessly supporting the body of a textile article as one edge of the textile article is moved by a feed means and a movable gripper means. The apparatus includes: (a) a cable having one end connected to one of the feed means and the gripper means for supporting the body of the textile article; and (b) retracting means connected to the other end of the cable and mounted adjacent to the other of the feed means and the gripper means, whereby the cable is retracted into the retracting means as the edge of the textile article is moved.

Still another aspect of the present invention is to provide an apparatus for automatically feeding one edge of a textile article to a sewing machine. The apparatus includes: (a) first gripper means adjacent to the sewing machine for gripping the leading portion of the edge of the textile article; (b) feed means adjacent to the first gripper means for advancing the edge of the textile article with respect to the sewing machine; (c) second gripper means for gripping the trailing portion of the edge of the textile article; (d) positioner means supporting the second gripper means for moving the second gripper with respect to the feed means; (e) control means for controlling the movement of the positioner to advance the trailing portion of the edge of the textile article in response to the movement of the leading portion of the edge of the textile article; and (f) support means located between the first gripper means and the second gripper means for supporting the body of the textile article as the edge of the textile article is moved toward the sewing machine. The support means includes: (i) a cable having one end connected to one of the feed means and the gripper means for supporting the body of the textile article; and (ii) retracting means connected to the other end of the cable and mounted adjacent to the other of the feed means and the gripper means, whereby the cable is retracted into the retracting means as the edge of the textile article is moved.

These and other aspects of the present invention will become apparent to those skilled in the art after a reading of the following description of the preferred embodiment when considered with the drawings.

BRIEF DESCRIPTION OF THE DRAWINGS

FIG. 1 is a front view on a completed garment body having a collarette fabricated in part according to the present invention;

FIG. 2 is a front view of an uncompleted garment without the collarette prior to being fed to the sewing machine by the present invention;

DESCRIPTION OF THE PREFERRED EMBODIMENTS

Figure 3:
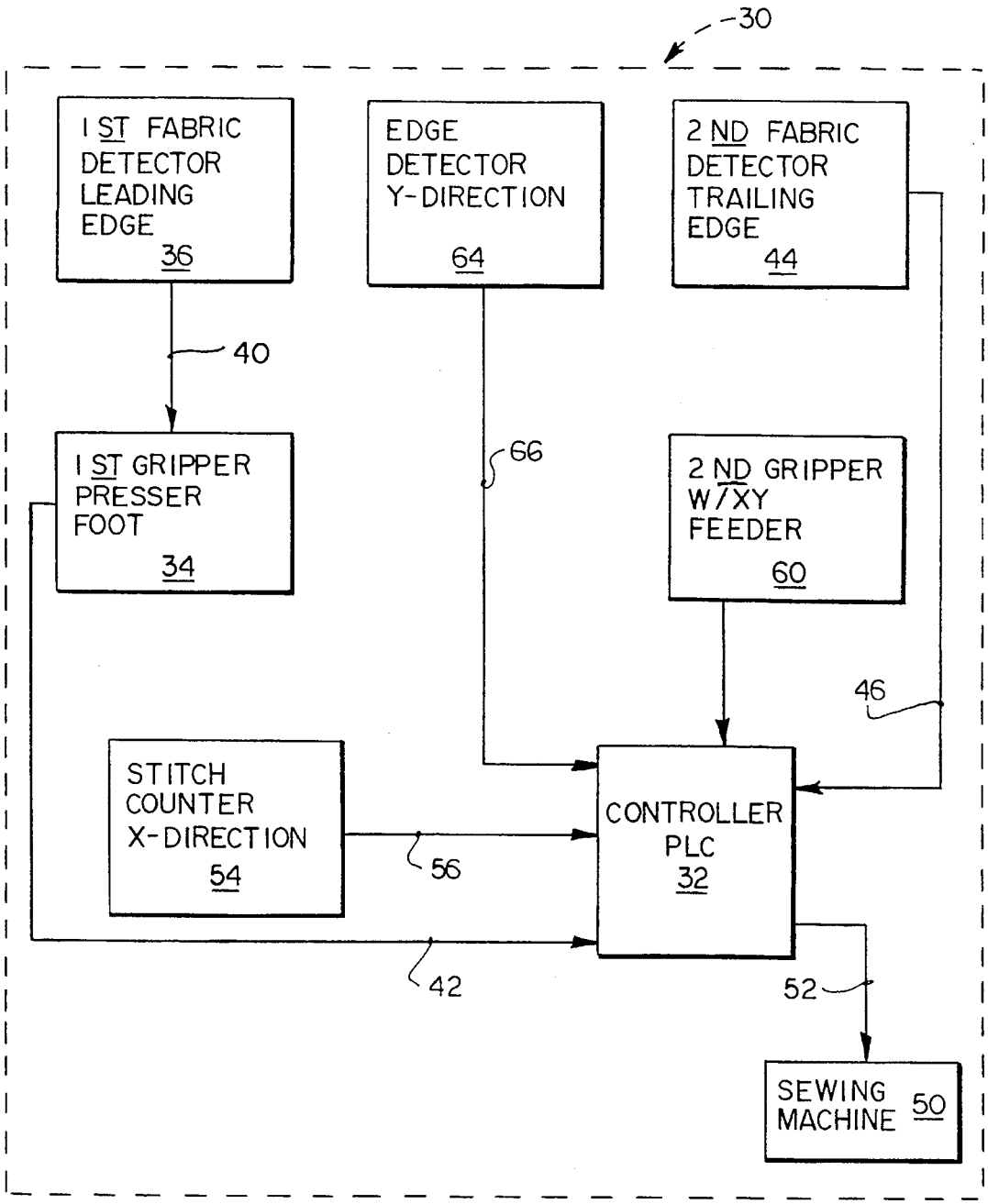
FIG. 3 is a block diagram illustrating a guide/feeder constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a sleeveless garment body 10 is shown. Garment body 10 includes a collarette 12 and a label 14 fashioned from known materials used for shirts, blouses or the like. The dimensions of various pieces are based on the desired size of the finished product. For example, in an average medium-sized T-shirt, the width of the collarette 12 is typically in the range of 1 3/16 to 1 7/16 inches. As will readily become apparent to those skilled in the art, the width of the collarette can be easily varied.

Label 14 provides the purchaser with information concerning the garment, for example, size, manufacturer and washing instructions. After being fabricated in part by guide/feeder constructed according to the present invention, semi-completed garment body 10 has a shoulder seam 16 which is sewn in an open shoulder 20 which is sewn in a subsequent operation. Right sleeve opening 22 and left sleeve opening 24 are likewise sewn in subsequent operations. However, by letting a single operator sew shoulder seam 16 and then feed the garment body 10 with the present invention, one operator can perform the work of three. In addition, the skills required to sew shoulder seam 16 and feed the garment body by means of the guide/feeder of the present invention are much less than required for an operator to sew the garment in a conventional manner.

Turning now to FIG. 2, there is shown a front view of an uncompleted garment body without the collarette prior to being fed to the sewing machine by the present invention. As can be seen, shoulder seam 16 has already been sewn and the collarette portion 12 and the left sleeve portion opening 24 are stretched outwardly. As can also be seen, the uncompleted garment body without the collarette has only one shoulder seam, the right shoulder seam 16, sewn prior to being fed to the sewing machine according to the present invention. The open shoulder seam 20 is sewn subsequently to the collarette 12 being sewn to the garment body.

As also can be seen, the collarette portion of the garment body does not form a straight line and neither is the collarette sewn in a straight line. Rather both the collarette body and the collarette itself are curved such that when shoulder seam 20 subsequently is sewn together a round collar is formed. Such an operation requires that the garment body be controlled during the sewing operation such that both forward and lateral motion is accounted for. An experienced operator can do this automatically, however, heretofore, it has been impossible to do this automatically.

As best seen in FIG. 3, there is shown a block diagram illustrating a guide/feeder constructed according to the present invention generally designated 30. The heart of the guide/feeder 30 is a programmable logic controller 32. Programmable logic controller (PLC) 32 is a conventional unit and one unit which has proven particularly satisfactory is a model TSX-17 manufactured by Telemecanique of France. In order to control the movement of garment body 10 through the sewing machine and allow for both forward and lateral motion, it is necessary to engage collarette portion of the garment body both on the leading edge and the trailing edge. In this regard, a first gripper 34 engages the leading edge of the garment body 10.

In a preferred embodiment, the first gripping means 34 is a presser foot of the sewing machine. In the preferred embodiment, a first fabric detector is located adjacent to the first gripper means and provides a control signal 40 when the leading edge of the fabric is detected. Control signal 40 is received by the first gripper means and is engaged. When first gripper 34 receives the control signal 40 indicating the presence of the leading edge of the fabric of the garment body, a control signal 42 is sent to PLC 32 to indicate this condition. A second fabric detector 44 is adjacent to the second gripper for indicating the presence of the trailing edge of the fabric of the garment body 10. When the fabric is detected by second detector 44, a control signal 46 is sent to PLC 32. When both first fabric detector 36 and second fabric detector 44 indicate the presence of the garment body 10, a control signal 52 is sent by PLC 32 to sewing machine 50 by means of control signal 52.

As sewing machine 50 operates, a stitch counter 54 connected to sewing machine 50 provides a control signal 56 indicating the X direction (forward direction) of the material passing through the sewing machine 50. At the same time, PLC 32 provides a control signal 62 to the XY feeder attached to the second gripping means holding the trailing edge of the fabric and causes the feeder to move in relation to the fabric passing through the sewing machine. Because the collarette portion of the garment body is curved, an edge detector 64 adjacent to the sewing head of the sewing machine 50 monitors the lateral (Y direction) of movement of the fabric through the sewing machine.

Edge detector 64 sends a control signal to 66 to PLC 32 indicating the position of the garment edge as it passes through the sewing machine. PLC 32 provides a changing control signal 62 to maintain the relative position of the fabric edge of the garment body with respect to the sewing machine.

Figure 4:
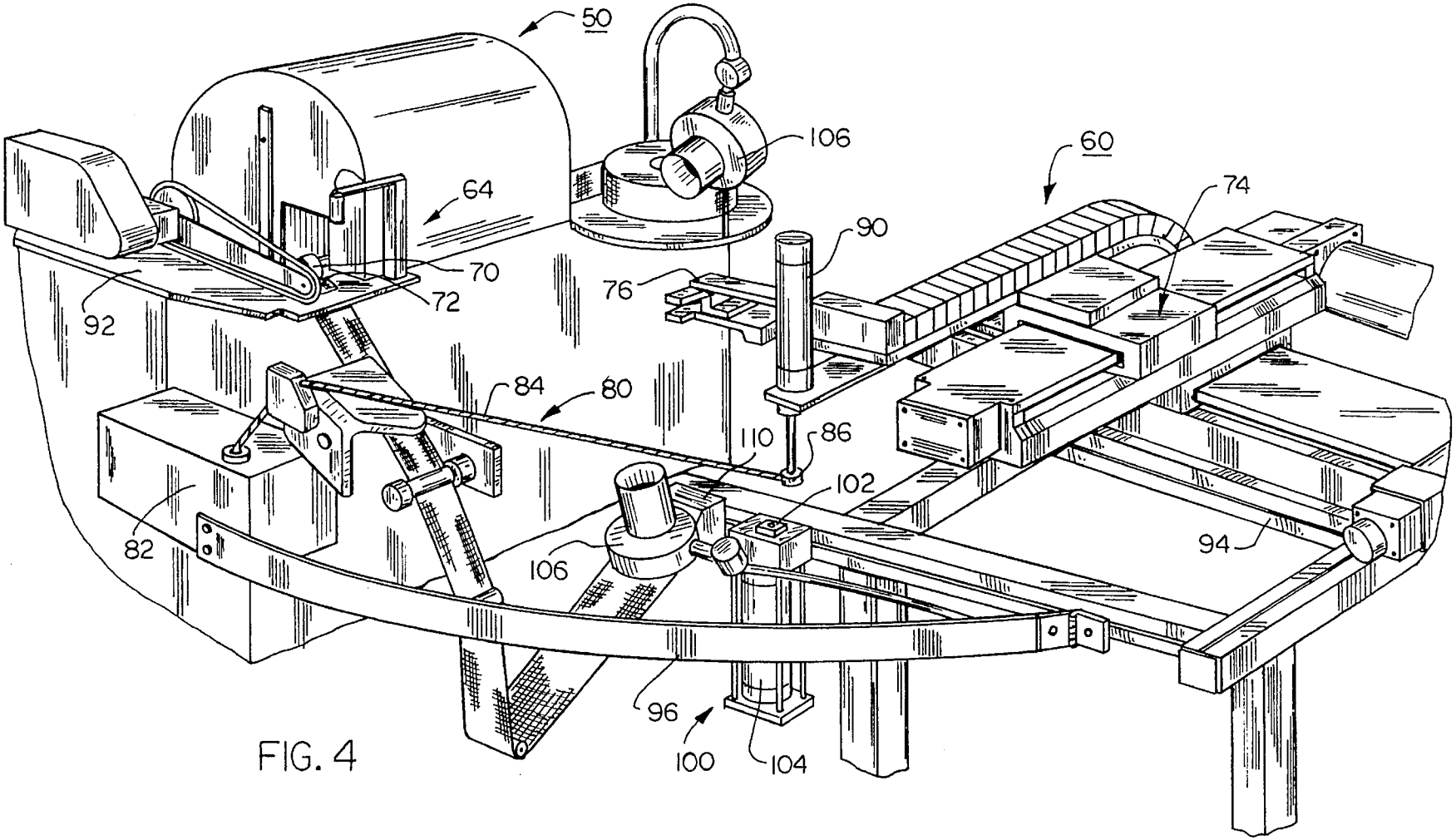
FIG. 4 is a perspective view of the guide/feeder constructed according to the present invention.
Figure 5:
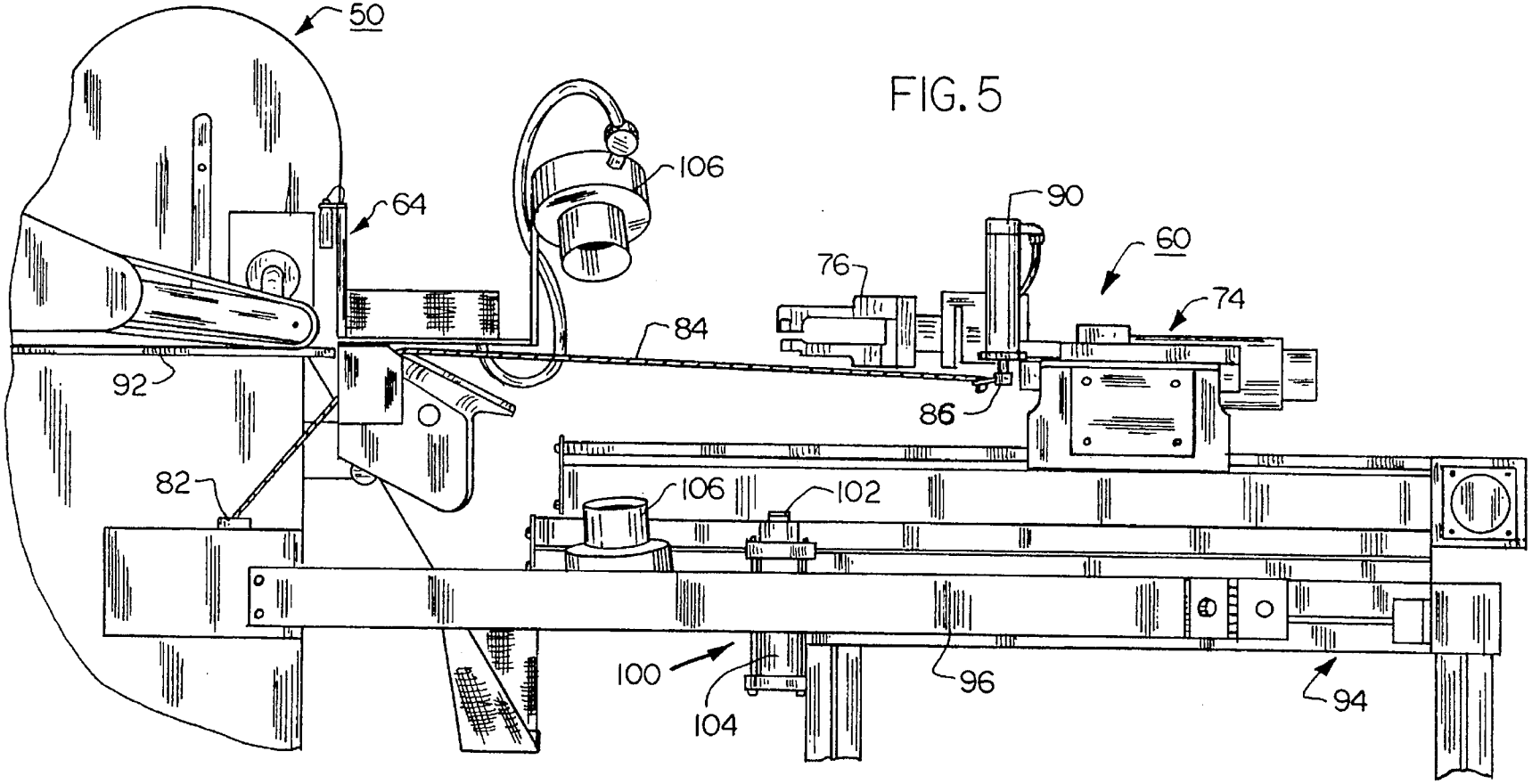
FIG. 5 is side elevational view of the guide/feeder shown in FIG. 4.

The relationship of the various components of the present invention shown in FIG. 3 can best be seen in FIG. 4 which is a perspective view of the guide feeder constructed according to the present invention. Sewing machine 50 is conventional in design. One machine which has proved particularly satisfactory is a Model 9M sewing machine manufactured by Union Special Company of Chicago, Ill.. This sewing machine includes a presser foot 70 opposite a series of feed dogs 72 for engaging the leading edge of the garment body. The gripper and feeder means generally designated 60 includes a conventional XY feeder 74 and a pneumatic second gripper means 76 attached to feeder 74. XY feeder 74 is conventional in design and one unit which is produced particularly satisfactory is a rail table manufactured by Daedal and the motors by Compumotor of Rohnert Park, Calif..

In the preferred embodiment, a frictionless support assembly 80 supports the garment body while the edge of the garment is being fed through the sewing machine. This provides support for the garment while eliminating stretching which could occur with a conventional support surface. Frictionless support assembly 80 includes a retractor 82 mounted adjacent to sewing machine 50 and a flexible steel plastic-covered cable 84 which is attached to second gripper 76 by connector 86. Second connector 86 is attached to a pneumatic cylinder 90 which moves between a first position adjacent to second gripper 76 in a second position out of the way of second gripper 76. Sewing machine assembly 50 and gripper feeder assembly 60 are supported by a conventional first work surface 92 and a second work surface 94. An operator bar 96 is attached between work surface 92 and work surface 94 for supporting the lower half of the garment as it moves through the sewing machine.

In the preferred embodiment, an optional fabric guide assembly 100 is mounted to the frame of work surface 94 and moved between an operable and inoperable position with respect to second gripper 76. Fabric guide assembly 100 includes a fabric guide 102 for aiding the operator in placing the trailing edge of the fabric of the garment body 10 into gripper 76 and a pneumatic cylinder 104 for moving the fabric guide between the operable and inoperable positions with respect to the gripper.

Figure 6:
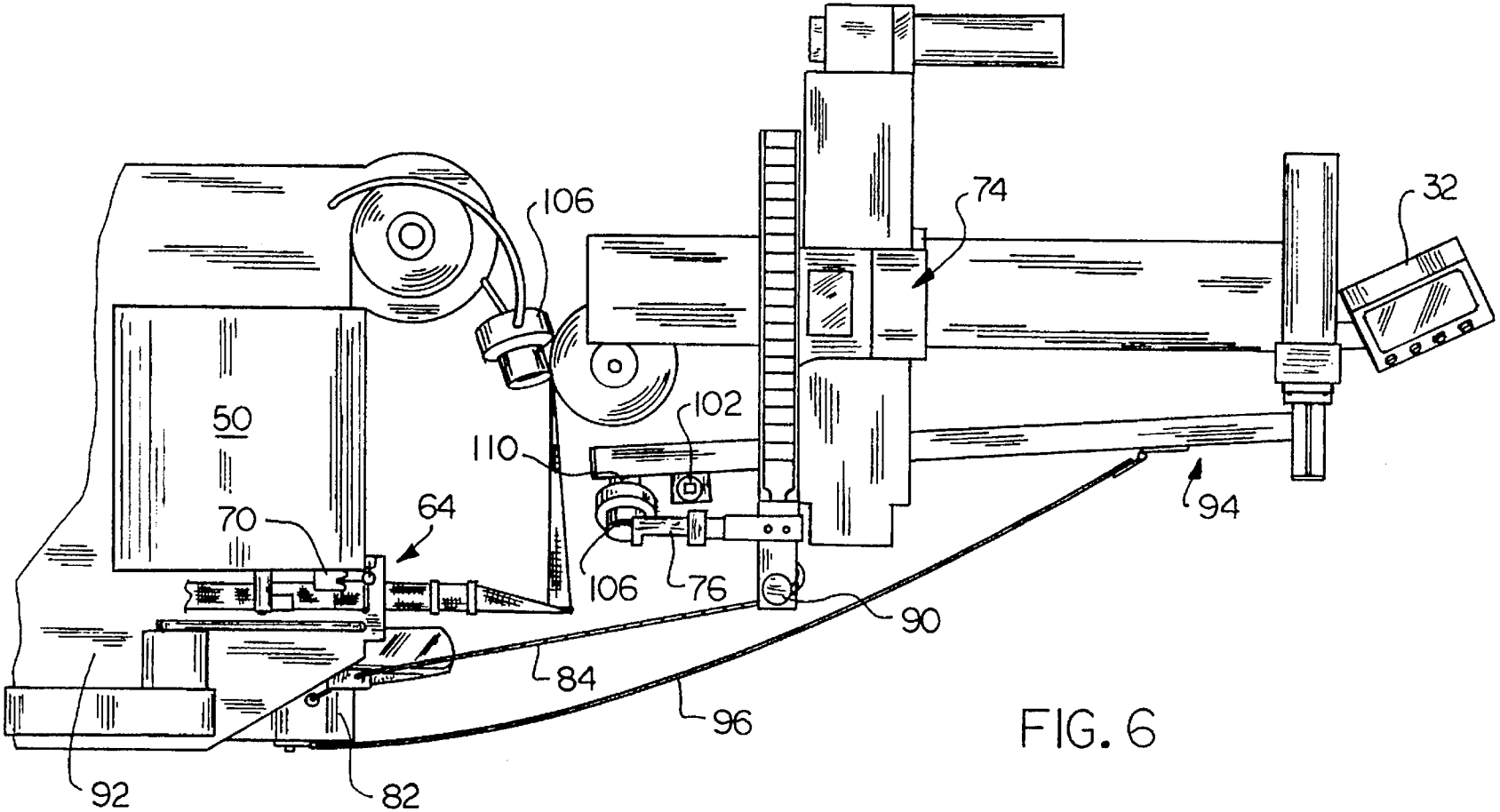
FIG. 6 is a top plan view of the guide/feeder shown in FIG. 4.

Turning to FIG. 6, there is a top plan view of the guide feeder constructed according to the present invention shown in FIG. 4. As can be seen in the preferred embodiment, a pneumatically powered blower 106 is mounted to the frame of work surface 94 by means of adjustable bracket 110. Blower 106 provides a pulse burst of air against the back surface of garment body 10 which causes garment body 10 to lay flat across frictionless support surface 80 and operator bar 96.

Finally, FIG. 6 shows the location of the edge detector 64 adjacent to the presser foot of sewing machine 50. In the preferred embodiment, edge detector 64 includes an array of infrared LEDs and detectors mounted on one side of the textile article along the path of movement of the trailing portion of the edge of the textile article towards the sewing machine and a reflective surface on the other side of the textile article, whereby the position of the edge of the textile article is determined as the edge of the textile article moves through the path of the reflected light directed towards the detectors.

Certain modifications and improvements will occur to those skilled in the art upon a reading of the foregoing description. By way of example, conventional actuators with position indicators could be used in place of the servo actuators. Also, other known types of edge detectors could be used in place of the LED array of the preferred embodiment. It should be understood that all such modifications and improvements have been deleted herein for the sake of conciseness and readability but are properly within the scope of the following claims.

We claim:

1. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article, wherein said second gripper means includes a pair of opposed jaws and an actuator means for opening and closing said pair of opposed jaws to grip the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article; and (f) an edge detector for detecting the presence of the trailing portion of the edge of said textile article and for providing a control signal to close said pair of opposed jaws in response to detection of the trailing portion of the edge of said textile article.

2. The apparatus according to claim 1, wherein said first gripper means is attached to said sewing machine.

3. The apparatus according to claim 2, wherein said first gripper means is a presser foot attached to said sewing machine.

4. The apparatus according to claim 3, further including means for automatically actuating said presser foot to engage the leading portion of the edge of said textile article.

5. The apparatus according to claim 3, wherein said feed means is a feed dog adjacent to said presser foot.

6. The apparatus according to claim 1, wherein said actuator means for opening and closing said pair of opposed jaws is a pneumatic cylinder.

7. The apparatus according to claim 1, further including an edge guide adjacent to said jaws for aiding the insertion of the trailing portion of the edge of said textile article into said jaws.

8. The apparatus according to claim 7, wherein said edge guide for aiding the insertion of the trailing portion of the edge of said textile article into said jaws includes an actuator for moving said edge guide from a first operable position adjacent to said jaws to a second inoperable position disposed from said jaws.

9. The apparatus according to claim 1, wherein said positioner means supporting said second gripper means includes an X-Y feeder.

10. The apparatus according to claim 9, wherein said X-Y feeder is servo controlled in response to a control signal from said control means for controlling the movement of said positioner.

11. The apparatus according to claim 1, further including a stitch counter for providing a stitch input signal to said control means proportional to the number of stitches sewn by said sewing machine whereby said control means controls the movement of said positioner to advance the trailing portion of the edge of said textile article towards said sewing machine.

12. The apparatus according to claim 1, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

13. The apparatus according to claim 12, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

14. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article, wherein said second gripper means includes a pair of opposed jaws and an actuator means for opening and closing said pair of opposed jaws to grip the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article;

(f) support means located between said first gripper means and said second gripper means for supporting the body of said textile article as the edge of said textile article is moved toward said sewing machine; and (g) an edge detector for detecting the presence of the trailing portion of the edge of said textile article and for providing a control signal to close said pair of opposed jaws in response to detection of the trailing portion of the edge of said textile article.

15. The apparatus according to claim 14, wherein said first gripper means is attached to said sewing machine.

16. The apparatus according to claim 15, wherein said first gripper means is a presser foot attached to said sewing machine.

17. The apparatus according to claim 16, further including means for automatically actuating said presser foot to engage the leading portion of the edge of said textile article.

18. The apparatus according to claim 16, wherein said feed means is a feed dog adjacent to said presser foot.

19. The apparatus according to claim 14, wherein said actuator means for opening and closing said pair of opposed jaws is a pneumatic cylinder.

20. The apparatus according to claim 14, further including an edge guide adjacent to said jaws for aiding the insertion of the trailing portion of the edge of said textile article into said jaws.

21. The apparatus according to claim 20, wherein said edge guide for aiding the insertion of the trailing portion of the edge of said textile article into said jaws includes an actuator for moving said edge guide from a first operable position adjacent to said jaws to a second inoperable position disposed from said jaws.

22. The apparatus according to claim 14, wherein said positioner means supporting said second gripper means includes an X-Y feeder.

23. The apparatus according to claim 22, wherein said X-Y feeder is servo controlled in response to a control signal from said control means for controlling the movement of said positioner.

24. The apparatus according to claim 14, further including a stitch counter for providing a stitch input signal to said control means proportional to the number of stitches sewn by said sewing machine whereby said control means controls the movement of said positioner to advance the trailing portion of the edge of said textile article towards said sewing machine.

25. The apparatus according to claim 14, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

26. The apparatus according to claim 25, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

27. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article; and (f) support means located between said first gripper means and said second gripper means for supporting the body of said textile article as the edge of said textile article is moved toward said sewing machine, said support means including: (i) a cable having one end connected to one of said feed means and said gripper means for supporting the body of said textile article; and (ii) retracting means connected to the other end of said cable and mounted adjacent to the other of said feed means and said gripper means, whereby said cable is retracted into said retracting means as the edge of said textile article is moved.

28. The apparatus according to claim 27, wherein said first gripper means is attached to said sewing machine.

29. The apparatus according to claim 28, wherein said first gripper means is a presser foot attached to said sewing machine.

30. The apparatus according to claim 29, further including means for automatically actuating said presser foot to engage the leading portion of the edge of said textile article.

31. The apparatus according to claim 30, wherein said feed means is a feed dog adjacent to said presser foot.

32. The apparatus according to claim 27, wherein said second gripper means includes a pair of opposed jaws and an actuator means for opening and closing said pair of opposed jaws to grip the trailing portion of the edge of said textile article.

33. The apparatus according to claim 32, wherein said actuator means for opening and closing said pair of opposed jaws is a pneumatic cylinder.

34. The apparatus according to claim 32, further including an edge detector for detecting the presence of the trailing portion of the edge of said textile article and for providing a control signal to close said pair of opposed jaws in response to detection of the trailing portion of the edge of said textile article.

35. The apparatus according to claim 32, further including an edge guide adjacent to said jaws for aiding the insertion of the trailing portion of the edge of said textile article into said jaws.

36. The apparatus according to claim 35, wherein said edge guide for aiding the insertion of the trailing portion of the edge of said textile article into said jaws includes an actuator for moving said edge guide from a first operable position adjacent to said jaws to a second inoperable position disposed from said jaws.

37. The apparatus according to claim 37, wherein said positioner means supporting said second gripper means includes an X-Y feeder.

38. The apparatus according to claim 37, wherein said X-Y feeder is servo controlled in response to a control signal from said control means for controlling the movement of said positioner.

39. The apparatus according to claim 27, further including a stitch counter for providing a stitch input signal to said control means proportional to the number of stitches sewn by said sewing machine whereby said control means controls the movement of said positioner to advance the trailing portion of the edge of said textile article towards said sewing machine.

40. The apparatus according to claim 27, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

41. The apparatus according to claim 40, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

42. The apparatus according to claim 27, further including a source of compressed air directed at the body of said textile article for stretching out said textile article as said textile article is moved toward said sewing machine.

43. The apparatus according to claim 27, further including a guide rail located between said feed means and said gripper means for guiding the lower portion of the body of said textile article.

44. The apparatus according to claim 27, wherein said cable includes a flexible plastic outer sheath.

45. The apparatus according to claim 27, wherein said retracting means is mounted to an actuator for moving said retracting means and the other end of said cable between a first operable position and a second inoperable position adjacent to the other of said feed means and said gripper means.

46. The apparatus according to claim 45, wherein said actuator is a pneumatic cylinder.

47. The apparatus according to claim 27, wherein the one end of said cable is mounted to an actuator for moving said one end of said cable between a first operable position and a second inoperable position adjacent to the other of said feed means and said gripper means.

48. The apparatus according to claim 47, wherein said actuator is a pneumatic cylinder.

49. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article, wherein said second gripper means includes a pair of opposed jaws and an actuator means for opening and closing said pair of opposed jaws to grip the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article; and (f) an edge guide adjacent to said jaws for aiding the insertion of the trailing portion of the edge of said textile article into said jaws.

50. The apparatus according to claim 49, wherein said first gripper means is attached to said sewing machine.

51. The apparatus according to claim 50, wherein said first gripper means is a presser foot attached to said sewing machine.

52. The apparatus according to claim 51, further including means for automatically actuating said presser foot to engage the leading portion of the edge of said textile article.

53. The apparatus according to claim 51, wherein said feed means is a feed dog adjacent to said presser foot.

54. The apparatus according to claim 49, wherein said actuator means for opening and closing said pair of opposed jaws is a pneumatic cylinder.

55. The apparatus according to claim 49, further including an edge detector for detecting the presence of the trailing portion of the edge of said textile article and for providing a control signal to close said pair of opposed jaws in response to detection of the trailing portion of the edge of said textile article.

56. The apparatus according to claim 49, wherein said edge guide for aiding the insertion of the trailing portion of the edge of said textile article into said jaws includes an actuator for moving said edge guide from a first operable position adjacent to said jaws to a second inoperable position disposed from said jaws.

57. The apparatus according to claim 49, wherein said positioner means supporting said second gripper means includes an X-Y feeder.

58. The apparatus according to claim 57, wherein said X-Y feeder is servo controlled in response to a control signal from said control means for controlling the movement of said positioner.

59. The apparatus according to claim 49, further including a stitch counter for providing a stitch input signal to said control means proportional to the number of stitches sewn by said sewing machine whereby said control means controls the movement of said positioner to advance the trailing portion of the edge of said textile article towards said sewing machine.

60. The apparatus according to claim 49, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

61. The apparatus according to claim 60, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

62. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article, wherein said second gripper means includes a pair of opposed jaws and an actuator means for opening and closing said pair of opposed jaws to grip the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article;

(f) support means located between said first gripper means and said second gripper means for supporting the body of said textile article as the edge of said textile article is moved toward said sewing machine; and (g) an edge guide adjacent to said jaws for aiding the insertion of the trailing portion of the edge of said textile article into said jaws.

63. The apparatus according to claim 62, wherein said first gripper means is attached to said sewing machine.

64. The apparatus according to claim 63, wherein said first gripper means is a presser foot attached to said sewing machine.

65. The apparatus according to claim 64, further including means for automatically actuating said presser foot to engage the leading portion of the edge of said textile article.

66. The apparatus according to claim 64, wherein said feed means is a feed dog adjacent to said presser foot.

67. The apparatus according to claim 62, wherein said actuator means for opening and closing said pair of opposed jaws is a pneumatic cylinder.

68. The apparatus according to claim 62, further including an edge detector for detecting the presence of the trailing portion of the edge of said textile article and for providing a control signal to close said pair of opposed jaws in response to detection of the trailing portion of the edge of said textile article.

69. The apparatus according to claim 68, wherein said edge guide for aiding the insertion of the trailing portion of the edge of said textile article into said jaws includes an actuator for moving said edge guide from a first operable position adjacent to said jaws to a second inoperable position disposed from said jaws.

70. The apparatus according to claim 62, wherein said positioner means supporting said second gripper means includes an X-Y feeder.

71. The apparatus according to claim 70, wherein said X-Y feeder is servo controlled in response to a control signal from said control means for controlling the movement of said positioner.

72. The apparatus according to claim 62, further including a stitch counter for providing a stitch input signal to said control means proportional to the number of stitches sewn by said sewing machine whereby said control means controls the movement of said positioner to advance the trailing portion of the edge of said textile article towards said sewing machine.

73. The apparatus according to claim 62, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

74. The apparatus according to claim 73, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

75. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means, wherein said positioner means supporting said second gripper means includes an X-Y feeder and wherein said X-Y feeder is servo controlled in response to a control signal from a control means for controlling the movement of said positioner; and (e) control means for controlling the movement of said positioner to advance the trailing portion of the edge of said textile article in response to the movement of the leading portion of the edge of said textile article.

76. The apparatus according to claim 75, wherein said first gripper means is attached to said sewing machine.

77. The apparatus according to claim 76, wherein said first gripper means is a presser foot attached to said sewing machine.

78. The apparatus according to claim 77, further including means for automatically actuating said presser foot to engage the leading portion of the edge of said textile article.

79. The apparatus according to claim 77, wherein said feed means is a feed dog adjacent to said presser foot.

80. The apparatus according to claim 75, wherein said second gripper means includes a pair of opposed jaws and an actuator means for opening and closing said pair of opposed jaws to grip the trailing portion of the edge of said textile article.

81. The apparatus according to claim 80, wherein said actuator means for opening and closing said pair of opposed jaws is a pneumatic cylinder.

82. The apparatus according to claim 80, further including an edge detector for detecting the presence of the trailing portion of the edge of said textile article and for providing a control signal to close said pair of opposed jaws in response to detection of the trailing portion of the edge of said textile article.

83. The apparatus according to claim 80, further including an edge guide adjacent to said jaws for aiding the insertion of the trailing portion of the edge of said textile article into said jaws.

84. The apparatus according to claim 83, wherein said edge guide for aiding the insertion of the trailing portion of the edge of said textile article into said jaws includes an actuator for moving said edge guide from a first operable position adjacent to said jaws to a second inoperable position disposed from said jaws.

85. The apparatus according to claim 75, further including a stitch counter for providing a stitch input signal to said control means proportional to the number of stitches sewn by said sewing machine whereby said control means controls the movement of said positioner to advance the trailing portion of the edge of said textile article towards said sewing machine.

86. The apparatus according to claim 75, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

87. The apparatus according to claim 86, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

88. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means, wherein said positioner means supporting said second gripper means includes an X-Y feeder and wherein said X-Y feeder is servo controlled in response to a control signal from a control means for controlling the movement of said positioner;

(e) control means for controlling the movement of said positioner to advance the trailing portion of the edge of said textile article in response to the movement of the leading portion of the edge of said textile article; and (f) support means located between said first gripper means and said second gripper means for supporting the body of said textile article as the edge of said textile article is moved toward said sewing machine.

89. The apparatus according to claim 88, wherein said first gripper means is attached to said sewing machine.

90. The apparatus according to claim 89, wherein said first gripper means is a presser foot attached to said sewing machine.

91. The apparatus according to claim 90, further including means for automatically actuating said presser foot to engage the leading portion of the edge of said textile article.

92. The apparatus according to claim 90, wherein said feed means is a feed dog adjacent to said presser foot.

93. The apparatus according to claim 88, wherein said second gripper means includes a pair of opposed jaws and an actuator means for opening and closing said pair of opposed jaws to grip the trailing portion of the edge of said textile article.

94. The apparatus according to claim 93, wherein said actuator means for opening and closing said pair of opposed jaws is a pneumatic cylinder.

95. The apparatus according to claim 93, further including an edge detector for detecting the presence of the trailing portion of the edge of said textile article and for providing a control signal to close said pair of opposed jaws in response to detection of the trailing portion of the edge of said textile article.

96. The apparatus according to claim 93, further including an edge guide adjacent to said jaws for aiding the insertion of the trailing portion of the edge of said textile article into said jaws.

97. The apparatus according to claim 96, wherein said edge guide for aiding the insertion of the trailing portion of the edge of said textile article into said jaws includes an actuator for moving said edge guide from a first operable position adjacent to said jaws to a second inoperable position disposed from said jaws.

98. The apparatus according to claim 88, further including a stitch counter for providing a stitch input signal to said control means proportional to the number of stitches sewn by said sewing machine whereby said control means controls the movement of said positioner to advance the trailing portion of the edge of said textile article towards said sewing machine.

99. The apparatus according to claim 88, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

100. The apparatus according to claim 99, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

101. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article; and (f) a stitch counter for providing a stitch input signal to said control means proportional to the number of stitches sewn by said sewing machine whereby said control means controls the movement of said positioner to advance the trailing portion of the edge of said textile article towards said sewing machine.

102. The apparatus according to claim 101, wherein said first gripper means is attached to said sewing machine.

103. The apparatus according to claim 102, wherein said first gripper means is a presser foot attached to said sewing machine.

104. The apparatus according to claim 103, further including means for automatically actuating said presser foot to engage the leading portion of the edge of said textile article.

105. The apparatus according to claim 103, wherein said feed means is a feed dog adjacent to said presser foot.

106. The apparatus according to claim 101, wherein said second gripper means includes a pair of opposed jaws and an actuator means for opening and closing said pair of opposed jaws to grip the trailing portion of the edge of said textile article.

107. The apparatus according to claim 106, wherein said actuator means for opening and closing said pair of opposed jaws is a pneumatic cylinder.

108. The apparatus according to claim 106, further including an edge detector for detecting the presence of the trailing portion of the edge of said textile article and for providing a control signal to close said pair of opposed jaws in response to detection of the trailing portion of the edge of said textile article.

109. The apparatus according to claim 106, further including an edge guide adjacent to said jaws for aiding the insertion of the trailing portion of the edge of said textile article into said jaws.

110. The apparatus according to claim 109, wherein said edge guide for aiding the insertion of the trailing portion of the edge of said textile article into said jaws includes an actuator for moving said edge guide from a first operable position adjacent to said jaws to a second inoperable position disposed from said jaws.

111. The apparatus according to claim 101, wherein said positioner means supporting said second gripper means includes an X-Y feeder.

112. The apparatus according to claim 111, wherein said X-Y feeder is servo controlled in response to a control signal from said control means for controlling the movement of said positioner.

113. The apparatus according to claim 101, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

114. The apparatus according to claim 113, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

115. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article;

(f) support means located between said first gripper means and said second gripper means for supporting the body of said textile article as the edge of said textile article is moved toward said sewing machine; and (g) a stitch counter for providing a stitch input signal to said control means proportional to the number of stitches sewn by said sewing machine whereby said control means controls the movement of said positioner to advance the trailing portion of the edge of said textile article towards said sewing machine.

116. The apparatus according to claim 115, wherein said first gripper means is attached to said sewing machine.

117. The apparatus according to claim 116, wherein said first gripper means is a presser foot attached to said sewing machine.

118. The apparatus according to claim 117, further including means for automatically actuating said presser foot to engage the leading portion of the edge of said textile article.

119. The apparatus according to claim 117, wherein said feed means is a feed dog adjacent to said presser foot.

120. The apparatus according to claim 115, wherein said second gripper means includes a pair of opposed jaws and an actuator means for opening and closing said pair of opposed jaws to grip the trailing portion of the edge of said textile article.

121. The apparatus according to claim 120, wherein said actuator means for opening and closing said pair of opposed jaws is a pneumatic cylinder.

122. The apparatus according to claim 120, further including an edge detector for detecting the presence of the trailing portion of the edge of said textile article and for providing a control signal to close said pair of opposed jaws in response to detection of the trailing portion of the edge of said textile article.

123. The apparatus according to claim 120, further including an edge guide adjacent to said jaws for aiding the insertion of the trailing portion of the edge of said textile article into said jaws.

124. The apparatus according to claim 123, wherein said edge guide for aiding the insertion of the trailing portion of the edge of said textile article into said jaws includes an actuator for moving said edge guide from a first operable position adjacent to said jaws to a second inoperable position disposed from said jaws.

125. The apparatus according to claim 115, wherein said positioner means supporting said second gripper means includes an X-Y feeder.

126. The apparatus according to claim 125, wherein said X-Y feeder is servo controlled in response to a control signal from said control means for controlling the movement of said positioner.

127. The apparatus according to claim 115, further including an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine.

128. The apparatus according to claim 127, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

129. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article; and (f) an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

130. The apparatus according to claim 129, wherein said first gripper means is attached to said sewing machine.

131. The apparatus according to claim 130, wherein said first gripper means is a presser foot attached to said sewing machine.

132. The apparatus according to claim 131, further including means for automatically actuating said presser foot to engage the leading portion of the edge of said textile article.

133. The apparatus according to claim 131, wherein said feed means is a feed dog adjacent to said presser foot.

134. The apparatus according to claim 129, wherein said second gripper means includes a pair of opposed jaws and an actuator means for opening and closing said pair of opposed jaws to grip the trailing portion of the edge of said textile article.

135. The apparatus according to claim 134, wherein said actuator means for opening and closing said pair of opposed jaws is a pneumatic cylinder.

136. The apparatus according to claim 134, further including an edge detector for detecting the presence of the trailing portion of the edge of said textile article and for providing a control signal to close said pair of opposed jaws in response to detection of the trailing portion of the edge of said textile article.

137. The apparatus according to claim 134, further including an edge guide adjacent to said jaws for aiding the insertion of the trailing portion of the edge of said textile article into said jaws.

138. The apparatus according to claim 137, wherein said edge guide for aiding the insertion of the trailing portion of the edge of said textile article into said jaws includes an actuator for moving said edge guide from a first operable position adjacent to said jaws to a second inoperable position disposed from said jaws.

139. The apparatus according to claim 129, wherein said positioner means supporting said second gripper means includes an X-Y feeder.

140. The apparatus according to claim 139, wherein said X-Y feeder is servo controlled in response to a control signal from said control means for controlling the movement of said positioner.

141. The apparatus according to claim 129, further including a stitch counter for providing a stitch input signal to said control means proportional to the number of stitches sewn by said sewing machine whereby said control means controls the movement of said positioner to advance the trailing portion of the edge of said textile article towards said sewing machine.

142. An apparatus for automatically feeding one edge of a textile article to a sewing machine, said apparatus comprising:

(a) first gripper means adjacent to said sewing machine for gripping the leading portion of the edge of said textile article;

(b) feed means adjacent to said first gripper means for advancing the edge of said textile article with respect to said sewing machine;

(c) second gripper means for gripping the trailing portion of the edge of said textile article;

(d) positioner means supporting said second gripper means for moving said second gripper with respect to said feed means;

(e) control means for controlling the movement of said positioner to advance the trailing portion of the edge of said textile article in response to the movement of the leading portion of the edge of said textile article;

(f) support means located between said first gripper means and said second gripper means for supporting the body of said textile article as the edge of said textile article is moved toward said sewing machine; and (g) an edge sensor for providing an edge input signal to said control means indicative of the position of the edge of said textile article whereby said control means controls the movement of said positioner to guide the edge of said textile article laterally to the path of movement of the trailing portion of the edge of said textile article towards said sewing machine, wherein said edge sensor includes an array of infrared LEDs and detectors mounted on one side of said textile article along the path of movement of the trailing portion of the edge of said textile article towards said sewing machine and a reflective surface on the other side of said textile article, whereby the position of the edge of said textile article is determined as the edge of said textile article moves through the path of the reflected light directed towards the detectors.

143. The apparatus according to claim 142, wherein said first gripper means is attached to said sewing machine.

144. The apparatus according to claim 143, wherein said first gripper means is a presser foot attached to said sewing machine.

145. The apparatus according to claim 144, further including means for automatically actuating said presser foot to engage the leading portion of the edge of said textile article.

146. The apparatus according to claim 144, wherein said feed means is a feed dog adjacent to said presser foot.

147. The apparatus according to claim 144, wherein said second gripper means includes a pair of opposed jaws and an actuator means for opening and closing said pair of opposed jaws to grip the trailing portion of the edge of said textile article.

148. The apparatus according to claim 147, wherein said actuator means for opening and closing said pair of opposed jaws is a pneumatic cylinder.

149. The apparatus according to claim 147, further including an edge detector for detecting the presence of the trailing portion of the edge of said textile article and for providing a control signal to close said pair of opposed jaws in response to detection of the trailing portion of the edge of said textile article.

150. The apparatus according to claim 147, further including an edge guide adjacent to said jaws for aiding the insertion of the trailing portion of the edge of said textile article into said jaws.

151. The apparatus according to claim 150, wherein said edge guide for aiding the insertion of the trailing portion of the edge of said textile article into said jaws includes an actuator for moving said edge guide from a first operable position adjacent to said jaws to a second inoperable position disposed from said jaws.

152. The apparatus according to claim 142, wherein said positioner means supporting said second gripper means includes an X-Y feeder.

153. The apparatus according to claim 152, wherein said X-Y feeder is servo controlled in response to a control signal from said control means for controlling the movement of said positioner.

154. The apparatus according to claim 142, further including a stitch counter for providing a stitch input signal to said control means proportional to the number of stitches sewn by said sewing machine whereby said control means controls the movement of said positioner to advance the trailing portion of the edge of said textile article towards said sewing machine.

* * * * *